US006454182B1

(12) United States Patent
Bucceri

(10) Patent No.: US 6,454,182 B1
(45) Date of Patent: Sep. 24, 2002

(54) SNOW MAKING METHOD AND APPARATUS

(75) Inventor: Alfio Bucceri, Newmarket (AU)

(73) Assignee: Bucceri Technologies Pty Ltd., Brisbane (AU)

( * ) Notice: Subject to any disclaimer, the term of this patent is extended or adjusted under 35 U.S.C. 154(b) by 0 days.

(21) Appl. No.: 09/673,705

(22) PCT Filed: Apr. 23, 1999

(86) PCT No.: PCT/AU99/00312

§ 371 (c)(1),
(2), (4) Date: Oct. 18, 2000

(87) PCT Pub. No.: WO99/56067

PCT Pub. Date: Nov. 4, 1999

(30) Foreign Application Priority Data

Apr. 23, 1998 (AU) ..... PP3120

(51) Int. Cl.[7] ..... F25C 3/04
(52) U.S. Cl. ..... 239/14.2; 239/116
(58) Field of Search ..... 239/2.2, 14.2, 239/104, 106, 114, 115, 116, 416.4, 416.5, 423; 62/74, 347, 353; 222/102; 138/114, 119, 178

(56) References Cited

U.S. PATENT DOCUMENTS

| | | | | |
|---|---|---|---|---|
| 2,519,844 A | | 8/1950 | Mojonnier | |
| 4,194,689 A | * | 3/1980 | Ash | 239/14.2 |
| 4,275,833 A | * | 6/1981 | Fairbank | 239/2.2 |
| 5,297,731 A | | 3/1994 | Bucceri | |
| 5,427,274 A | * | 6/1995 | Wood | 222/1 |

FOREIGN PATENT DOCUMENTS

| | | |
|---|---|---|
| AU | 668285 | 11/1995 |
| DE | 1915337 | 10/1970 |
| FR | 2 613 639 | 10/1988 |
| NL | 7411523 | 3/1976 |

* cited by examiner

*Primary Examiner*—Lisa A. Douglas
(74) *Attorney, Agent, or Firm*—Hudak & Shunk Co., L.P.A.

(57) ABSTRACT

A snow making machine has at least one flexible hose assembly, with an inner hose connected to a water supply and an outer jacket to receive coolant from a chiller. Ice/snow formed in the inner hose is dislodged by inflating squasher hoses in the outer jacket, and pressurised air fed via a line can assist transport of the dry snow crystals to the end of the hose assembly.

18 Claims, 3 Drawing Sheets

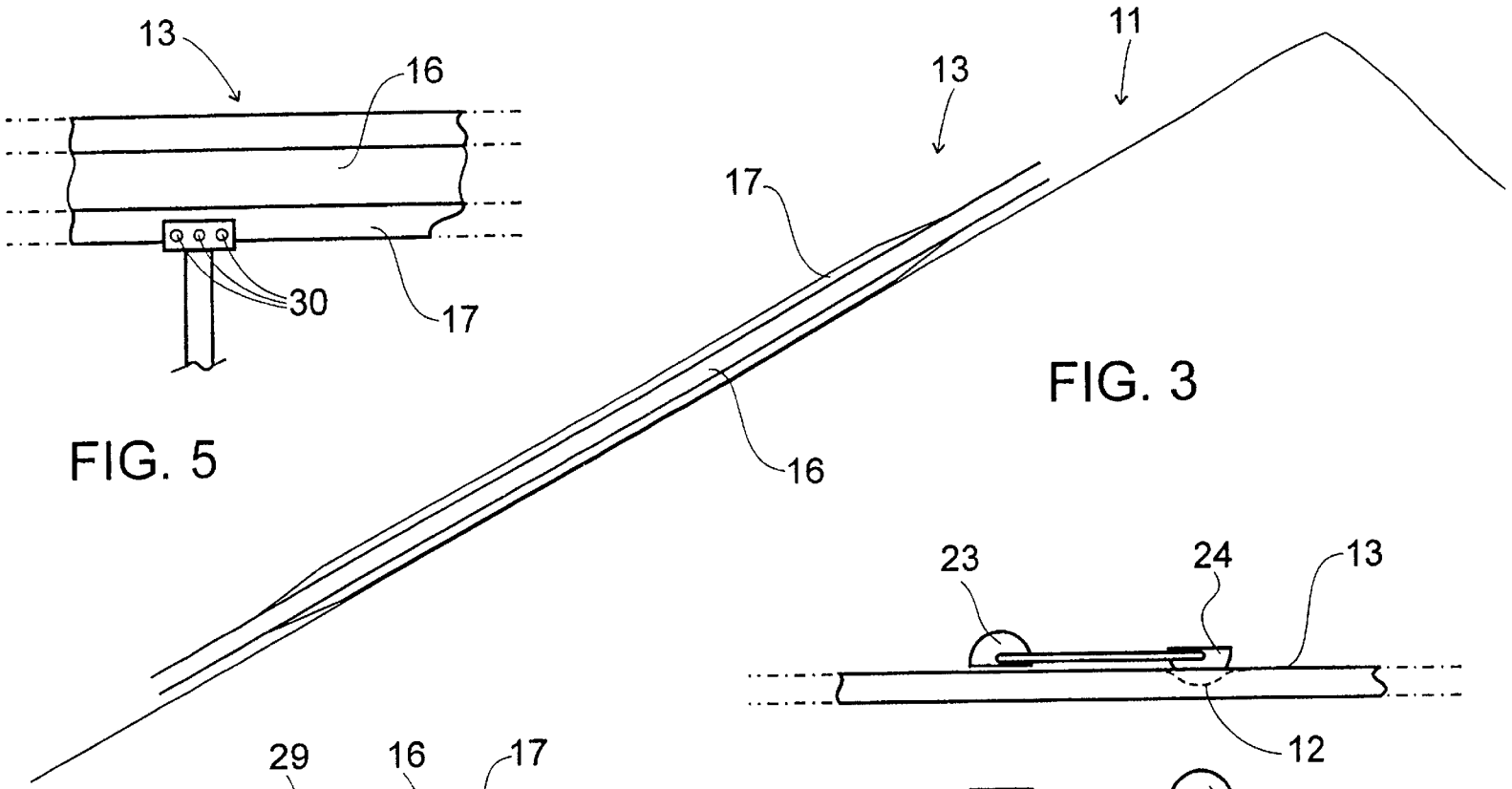
FIG. 3
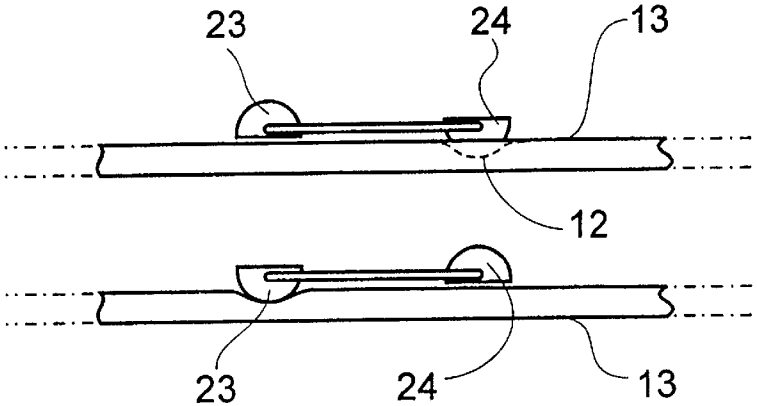
FIG. 6
FIG. 5
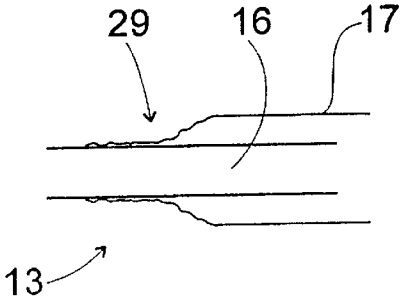
FIG. 4

SNOW MAKING METHOD AND APPARATUS

BACKGROUND OF THE INVENTION

1. Field of the Invention

THIS INVENTION relates to improvements in or relating to artificial snow making machines and ice making apparatus and, in particular, but not limited to, portable or semi-portable snow making machines capable of use on all terrains.

2. Prior Art

The present invention arises out of the perceived need to provide alternative snow making machines which are very simple to operate and which can be readily moved about a site on any terrain, eg., on a ski slope or hill, and to provide snow at a variety of locations with or without the use of refrigeration equipment.

The snow making techniques and apparatus disclosed in U.S. Pat. No. 5,297,731 (ALFIO BUCCERI) suffered from a number of disadvantages. The machinery was limited to a particular area of snow production only, being bulky and difficult to move around a field. As well, the machine could not be easily used on an unprepared or rough ground. The coolant requirement was high, and one leak could lead to a costly replacement. The machines could not be economically produced in bulk supply, due to the many man hours required to produce a machine. The method of dislodging the ice crystals could cause machinery downtime, due to the fact that one roller mechanism was working on multiple hoses. Therefore, if one hose failed, all the other hoses were non-productive while repairs were effected. In addition, the end product was sometimes too wet for immediate use and required further drainage, and the hoses were limited to short lengths due to the complexity of the machinery.

SUMMARY OF THE PRESENT INVENTION

An object of the present invention is to alleviate at least to some degree the abovementioned problems associated with the prior art and to greatly increase the capacity and portability of the machine.

Other objects will become apparent from the following description.

In one aspect, the present invention resides in a hose assembly for a snow-making machine including:

an inner hose having an inlet connectable to a source of water and an outlet for the discharge of the snow;

an outer jacket, surrounding the inner hose, connectable to a source of coolant; and at least one pulsation tube within the outer jacket, connectable to a source of pressurised air or fluid, the pulsation tube(s) being operable, on the admission of the pressurised air or fluid, to deform the inner hose to thereby release any snow attached to the inner surface of the inner hose and/or advance the snow towards the outlet of the inner hose.

In a second aspect, the present invention resides in a hose assembly for a snow making machine including:

an inner hose having an inlet connectable to a source of water and an outlet for the discharge of the snow;

an outer jacket, surrounding the inner hose, connectable to a source of coolant; and an air hose, connectable to a source of compressed air, operable to supply the compressed air to the interior of the inner hose to transport dry snow in the inner hose towards the outlet thereof.

In a third aspect, the present invention resides in a hose assembly for a snow-making machine including:

an inner hose having an inlet connectable to a source of water and an outlet for the discharge of snow;

an outer jacket connectable to a source of coolant;

at least one pulsation tube, within the outer jacket, connectable to a source of pressurised air or fluid, the pulsation tube(s) being operable, on the admission of the pressurised air or fluid to deform the inner hose to thereby release any snow attached to the inner surface of the inner hose and/or advance the snow towards the outlet of the inner hose; and an air hose within the inner hose, connectable to a source of compressed air, operable to supply the compressed air to the interior of the inner hose to transport dry snow in the inner hose towards the outlet thereof.

The hose assemblies are flexible and portable so that one or more hose assemblies can be rolled up together for transport purposes and later laid out flat for production of artificial snow.

The inner hose preferably protrudes from each end of the outer jacket, and the outer jacket and inner hose are connected together adjacent the ends of the inner hose, and are both jointly flexible along their combined length, including at their connections.

Hose deformation means are preferably employed to deform the hose to release ice forming on inner walls of the inner hose. The deformation means of the first and third embodiments comprises a single pulsation tube, or multiple pulsation tubes, that is/are connected to the inner wall of the outer jacket so that, when filled with air or fluid under pressure, they deform the walls of the inner hose.

The introduction of pressure at regular intervals to the pulsation tube(s) that deform the inner hose, if effected in sequence from the inlet (or bottom) end to the outer (or top) end, also has the effect of squeezing and delivering the ice crystals that have formed to the outlet (or top) end of the hose where fluid is not present. Further pressure from the pulsation tube(s) adjacent the outlet end allows for the further squeezing of water from the ice to create a dry snow product which can be blown or delivered directly from the outlet end to the usage point without the need for drainage of the inner hose.

For the second embodiment, a roller, or pair of offset rollers, are adapted to travel along the hose assembly, from end to end, periodically deforming and releasing the hose assembly so that the ice can be periodically discharged into the volume of water within the inner hose without threat of blockage.

The rollers are preferably interconnected and a pair of guide rails are preferably employed for the rollers to travel along.

In one preferred embodiment, the hose assembly is laid out on an incline and the rollers are retrieved using a winch and allowed to travel by gravity down the slope while at the same time periodically deforming and releasing the hose assembly as they go. The process is repeated over and over again.

The hose assembly (or assemblies) can be laid in various forms which need not be a straight line.

The outer jacket of the hose assembly can be manufactured from a highly conductive material such as thin plastic (eg., polyurethane) or metal foil material, to allow for the use of the hose without refrigeration at locations such as ski resorts where the temperature is well below freezing. In this application, the outer hose is cooled by the surrounding air which transfers the heat from the coolant to air and chills the coolant without the need for a refrigeration plant to create the ice crystals from the water within the inner hose. In this application, the hose is laid on the hill and the inner hose is filled with water and the gap between the inner and outer hose filled with coolant. The low ambient air temperature chills the coolant which in turn chills the water in the inner tube and ice crystals are formed. As air is introduced to the pulsation tube, the ice crystals are dislodged, moved to the top of the hose and dried. The snow is blown directly from the top of the hose.

The inner hose is preferably formed from a tightly-woven flexible material lined with a thin impervious plastics, or rubber, material.

In a fourth aspect, the present invention resides in a snow making machine including:

a source of water;

a source of coolant;

pump means for the coolant; and at least one hose assembly as hereinbefore described, with the inlet(s) of the inner hose(s) connected to the source of water and the outer jacket(s) connected to the pump means for the coolant.

In order that the invention can be more readily understood and be put into practical effect, reference will now be made to the accompanying drawings which illustrate preferred embodiments of the present invention and wherein:

FIG. 3 is a typical section through 3—3 of FIG. 1;

FIG. 4 is an enlarged detail of an end portion of a hose assembly according to the present invention;

FIG. 5 is a section illustrating a connection for delivery of a brine coolant to the hose assembly according to the present invention;

FIG. 6 illustrates operation of a pair of rollers suitable for use in the embodiment of FIG. 1;

Figure 1:
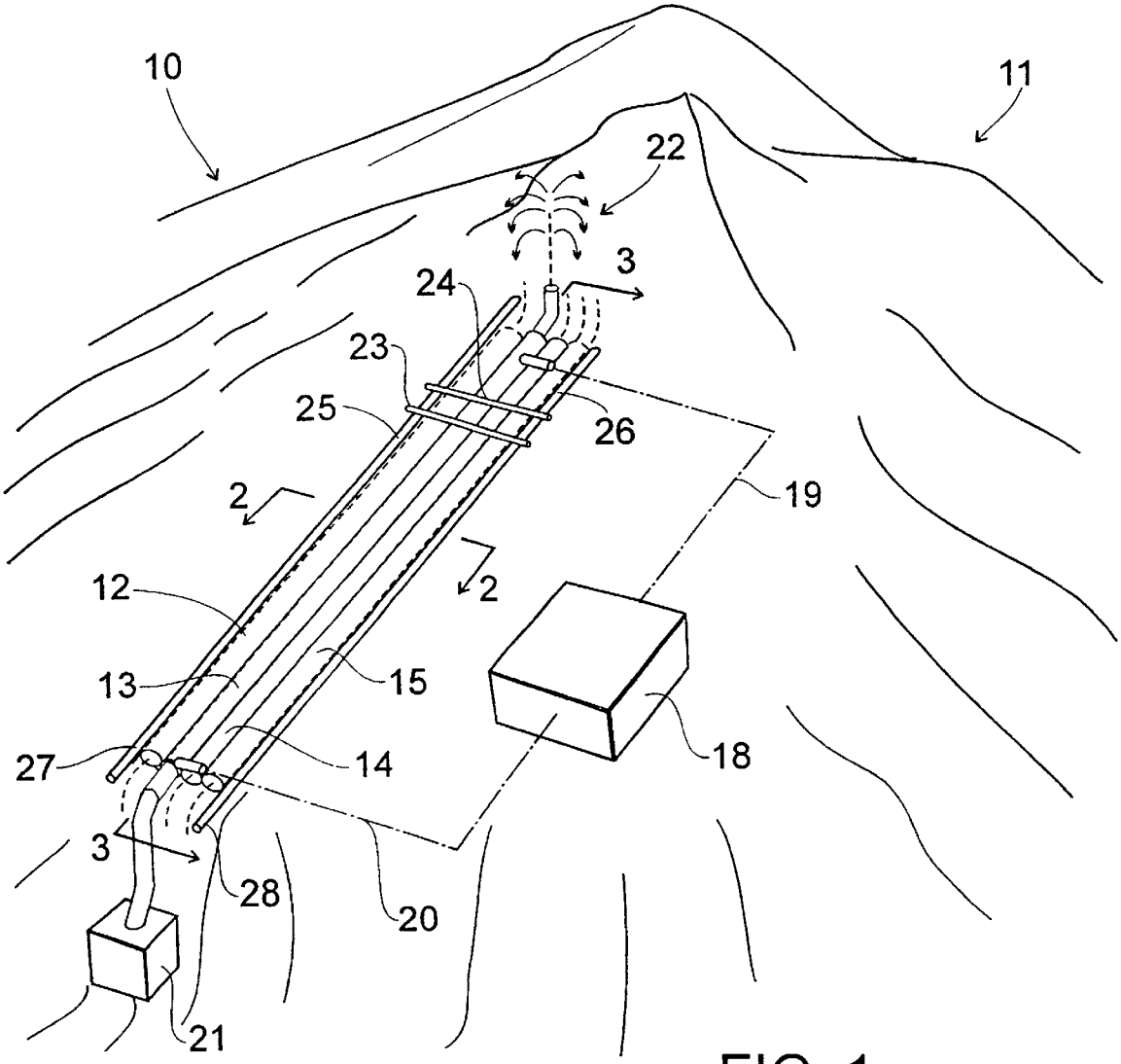
FIG. 1 is a schematic pictorial view illustrating a snow making machine according to the present invention.
Figure 2:
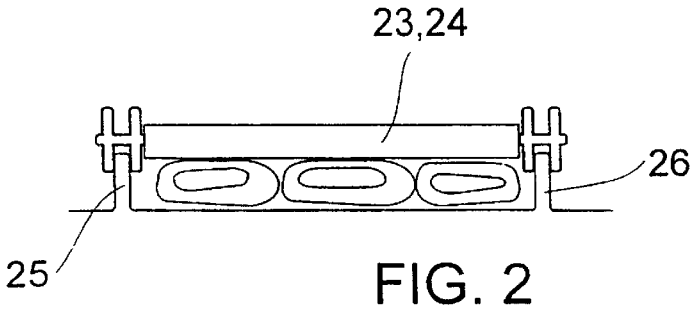
FIG. 2 is a typical section through 2—2 of FIG. 1.

Referring to the drawings and initially to FIG. 1, there is illustrated a snow making machine 10 for producing artificial snow positioned on a hill 11. The machine 10 includes four hose assemblies 12, 13, 14 and 15, three of which are shown in phantom, it being understood that a single hose assembly could be employed to operate the present invention.

As can be seen more clearly in FIG. 3, the hose 13 includes an inner hose 16 and an outer jacket 17 so that coolant (eg., brine) can be circulated between the outer jacket 17 and the inner hose 16 to form the ice within the inner hose 16.

A chiller 18 delivers the coolant (eg., at or below −5° C.) to the hoses along line 19, and the coolant is returned along line 20. Water is delivered into the hose assemblies from a pump 21 and this is also used to discharge ice and water from the hose assembly 22.

In order to release ice formed on the wall of the inner hose 16, the present invention, in one embodiment, uses deformation of the hose assemblies 13 using a pair of rollers 23 and 25 which travel in concert along rails 25 and 26.

Once the rollers have travelled the full distance to the ends 27 and 28, they can be retracted using suitable winch (not shown).

In order to operate the present invention, a flexible connection is made between the outer jacket 17 and the inner hose 16, and this is shown generally at 29 in FIG. 4. In this way, the rollers 23 and 24 can travel over the connection without any problem.

FIG. 5 illustrates the typical connection for delivery of coolant to the outer jacket 17 and, as can be seen, a plurality of holes 30 are employed to form a manifold for delivery of the coolant into the hose assemblies 13.

Referring now to FIG. 6, there is illustrated operation of the rollers 23 and 24 and, as can be seen, these are offset so that different hose assemblies are deformed at different times during the travel of the rollers along the hose assemblies. Thus, by using appropriate timing and control, continuous discharge of artificial snow can be achieved.

Figure 7:
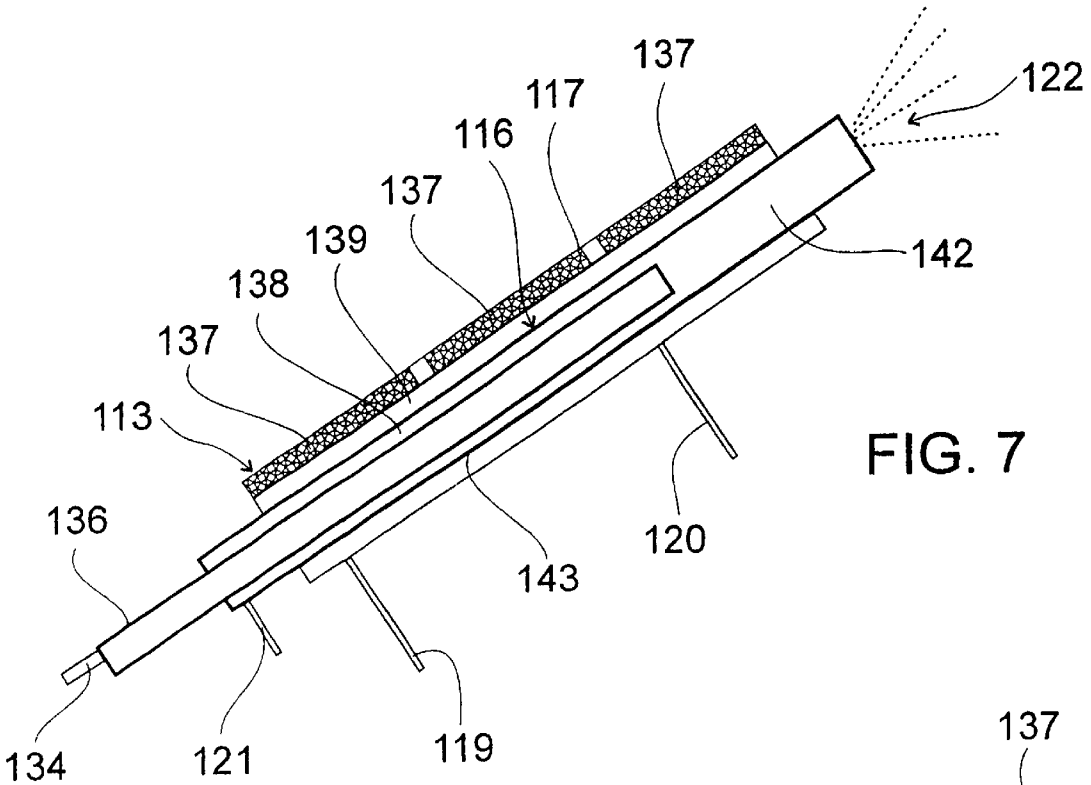
FIG. 7 is a schematic pictorial view illustrating a snow making hose assembly of a second embodiment of the present invention.

Referring to FIG. 7, there is illustrated an alternative snow making hose assembly 113 for producing artificial snow. A plurality of the hose assemblies can be employed to effect the present invention.

As can be seen more clearly in FIG. 7, the hose assembly 113 includes an inner hose 116 and an outer jacket 117 so that coolant 139 can be circulated between the jacket 117 and the inner hose 116 to form the ice 142 within the inner hose 116.

A chiller (not shown) delivers coolant 139 to the assembly 113 along line 119 and (brine) coolant is returned along line 120. Water is delivered into the hoses from a pump 121 and an air hose 136 is connected to an air receiver which is used to discharge dry ice from the hose assembly 113 at 122.

In order to release ice formed on the wall of the inner hose 116, this embodiment uses deformation of the inner hose 116 using a series of pulsation or "squasher" hoses 137 that are filled and emptied of air or fluid on a regular cycle. As the squasher hoses 137 are pressurised with water or fluid, they deform the inner hose 116 which returns to its undeformed state when the pressure is released.

Figure 8:
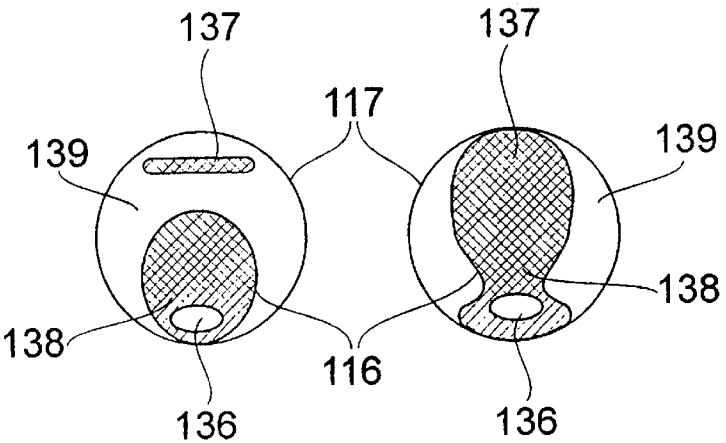
FIG. 8 is a typical section through the hose assembly shown in FIG. 7 during operation of the snow making squashing process.

Referring now to FIG. 8, there is illustrated operation of the squasher hoses 137, and as can be seen, that as these hoses 137 are pressurised, the inner hoses 116 are deformed. Thus, by using appropriate timing and control, the squeezing action produces a continuous discharge of artificial snow to the top of the hose assembly 113.

At the top of the snow assembly 113, in the dry area 142, the squeezing of the ice that has formed by the top squasher hoses 137 releases any excess water which drains back via gravity to the snow making water below the water level 143.

In order to operate the present invention, a flexible connection is made 115 between the jacket 117 and the hose 116 and this is shown generally at 29 in FIG. 4. In this way, the squasher hoses 137 can travel over the connection without any problem.

Various changes and modifications may be made to the embodiments described and illustrated without departing from the present invention.

What is claimed is:

1. A hose assembly for a snow-making machine including:

an inner hose having an inlet connectable to a source of water and an outlet for the discharge of snow;

an outer jacket, surrounding the inner hose, connectable to a source of coolant; and at least one pulsation tube within the outer jacket connectable to a source of pressurised air or fluid, the at least one pulsation tube being operable, on the admission of the pressurized air or fluid, to deform the inner hose to thereby release any snow attached to the inner surface of the inner hose and/or advance the snow towards the outlet of the inner hose.

2. An assembly as claimed in claim 1 wherein:

the inner hose protrudes from each end of the outer jacket, and the outer jacket and inner hose are connected together adjacent the ends of the inner hose, and are both jointly flexible along their combined length, including at their connections.

3. An assembly as claimed in claim 1 wherein:

at least one pulsation tube is connected to the inner wall of the outer jacket so that when filled with air or fluid under pressure, deform the wall of the surface of the inner hose.

4. An assembly as claimed in claim 3 wherein:

the introduction of pressure at regular intervals to the pulsation tube that deform the inner hose, is effected in sequence from the inlet end to the outer end to have the effect of squeezing and delivering the ice crystals that have formed in the inner hose to the outlet end of the inner hose where fluid is not present.

5. An assembly as claimed in claim 4 wherein:

further pressure from the pulsation tube(s) adjacent the outlet end allows for the further squeezing of water from the ice to create a dry snow product adapted to be blown or delivered directly from the outlet end to the usage point without the need for drainage of the inner hose.

6. An apparatus as claimed in claim 1 wherein:

the outer jacket of the hose is manufactured from a highly conductive material comprising polyurethane or metal foil material, to allow for the use of the hose without refrigeration at locations where the temperature is well below freezing, the outer hose being cooled by the surrounding air, which transfers the heat from the coolant to air and chills the coolant without the need for a refrigeration plant to create the ice crystals from the water within the inner hose.

7. A snow making machine including:

a source of water;

a source of coolant;

pump means for the coolant; and at least one hose assembly as claimed in claim 1 with the inlet(s) of the inner hose(s) connected to the source of water and the outer jacket(s) connected to the pump means for the coolant.

8. A hose assembly for a snow making machine including:

an inner hose having an inlet connectable to a source of water and an outlet for the discharge of snow;

an outer jacket, surrounding the inner hose, connectable to a source of coolant;

an air hose, connectable to a source of compressed air, operable to supply the compressed air to the interior of the inner hose to transport dry snow in the inner hose towards the outlet thereof; and a roller, or pair of offset rollers, are adapted to travel along the hose assembly, from end to end, periodically deforming and releasing the hose assembly so that the ice can be periodically discharged into the volume of water within the inner hose without threat of blockage.

9. An apparatus as claimed in claim 8 wherein:

the rollers are interconnected, and a pair of guide rails are employed for the rollers to travel along.

10. An apparatus as claimed in claim 8 wherein:

the hose assembly is laid out on an incline and the rollers are retrieved using a winch and allowed to travel by gravity down the slope while at the same time periodically deforming and releasing the hose assembly as they travel, the process being repeated over and over again.

11. An apparatus as claimed in claim 8, wherein:

a roller, or pair of offset rollers, are adapted to travel along the hose assembly, from end to end, periodically deforming and releasing the hose assembly so that the ice can be periodically discharged into the volume of water within the inner hose without threat of blockage.

12. A hose assembly for a snow-making machine including:

an inner hose having an inlet connectable to a source of coolant;

at least one pulsation tube, within the outer jacket, connectable to a source of pressurised air or fluid, the pulsation tube(s) being operable, on the admission of the pressurised air or fluid to deform the inner hose to thereby release any snow attached to the inner surface of the inner hose and/or advance the snow towards the outlet of the inner hose; and an air hose within the inner hose, connectable to a source of compressed air, operable to supply the compressed air to the interior of the inner hose to transport dry snow in the inner hose towards the outlet thereof.

13. An assembly as claimed in claim 12 wherein:

the inner hose protrudes from each end of the outer jacket, and the outer jacket and inner hose are connected together adjacent the ends of the inner hose, and are both jointly flexible along their combined length, including at their connections.

14. An assembly as claimed in claim 12 wherein:

at least one pulsation tube is connected to the inner wall of the outer jacket so that when filled with air or fluid under pressure, deform the wall of the surface of the inner hose.

15. An assembly as claimed in claim 14 wherein:

the introduction of pressure at regular intervals to the at least one pulsation tube that deform the inner hose, is effected in sequence from the inlet end to the outer end to have the effect of squeezing and delivering the ice crystals that have formed in the inner hose to the outlet end of the inner hose where fluid is not present.

16. An assembly as claimed in claim 15 wherein:

further pressure from the at least one pulsation tube adjacent the outlet end allows for the further squeezing of water from the ice to create a dry snow product adapted to be blown or delivered directly from the outlet end to the usage point without the need for drainage of the inner hose.

17. An apparatus as claimed in claim 12 wherein:

the outer jacket of the hose is manufactured from a highly conductive material comprising polyurethane or metal foil material, to allow for the use of the hose without refrigeration at locations where the temperature is well below freezing, the outer hose being cooled by the surrounding air, which transfers the heat from the coolant to air and chills the coolant without the need for a refrigeration plant to create the ice crystals from the water within the inner hose.

18. A snow making machine including:

a source of water;

a source of coolant;

pump means for the coolant; and at least one hose assembly as claimed in claim 12, with the inlet(s) of the inner hose(s) connected to the source of water and the outer jacket(s) connected to the pump means for the coolant.

* * * * *